United States Patent [19]

Hasler et al.

[11] 4,150,619

[45] Apr. 24, 1979

[54] PRINTER FOR DIFFERENT CHARACTER DENSITIES

[75] Inventors: Werner Hasler, Schoenaich; Eckart Lennemann; Subramaniam Padmanabhan, both of Herrenberg, all of Fed. Rep. of Germany

[73] Assignee: International Business Machines Corporation, Armonk, N.Y.

[21] Appl. No.: 842,848

[22] Filed: Oct. 17, 1977

[30] Foreign Application Priority Data

Dec. 2, 1976 [DE] Fed. Rep. of Germany ..... 2654569

[51] Int. Cl.[2] ..... B41J 9/30

[52] U.S. Cl. ..... 101/93.33; 101/93.48; 101/93.14

[58] Field of Search ..... 101/93.09, 93.01, 93.14, 101/93.29, 93.36, 93.48, 111

[56] References Cited

U.S. PATENT DOCUMENTS

| | | | |
|---|---|---|---|
| 3,332,343 | 7/1967 | Sims | 101/93.09 X |
| 3,715,978 | 2/1973 | Raider | 101/93.09 |
| 3,795,186 | 3/1974 | Curtiss et al. | 101/93.14 |
| 4,055,117 | 10/1977 | Munday | 101/93.14 |

OTHER PUBLICATIONS

Dowd, "Cooperating Print Hammers", *IBM Tech. Discl. Bulletin,* vol. 17, No. 4, 9/74, pp. 1012–1013.

Heydkamp et al., "Print Hammer Arrangement", *IBM Tech. Discl. Bulletin,* vol. 9, No. 8, 1/67, pp. 1013–1014.

*Primary Examiner*—Edward M. Coven

*Attorney, Agent, or Firm*—Kenneth P. Johnson

[57] ABSTRACT

Impact printing apparatus for recording at different character densities having an interposer unit movable between a plurality of print hammers and type chain to provide a translation function for the variable character-to-character distances required of the different character densities. During low density recording the interposer unit renders ineffective certain of the print hammers otherwise used for the higher density. A single type chain may be used with different interposer arrangements to obtain the various densities or type chains of different densities can be used.

8 Claims, 4 Drawing Figures

PRINTER FOR DIFFERENT CHARACTER DENSITIES

BACKGROUND OF THE INVENTION

The invention relates to a printing device for impact printers with a type chain and a hammer unit that is operable with an electromagnetic armature.

In all formerly known printers with rotating type chains the character density of the print images produced is constant. It is consequently not possible to produce a single printer text of different character densities.

From German Offenlegungsschrift No. 2 145 245 a printing device with a continuously rotating type roller is known which at its circumference carries a number of type fonts each staggered by one pitch distance in the longitudinal direction of the type roller, the print hammers being adjustable by means of a movable guide element to one of at least two type fonts. However, the different type fonts show the same pitch distance and consequently always supply print images of the same character density.

It is therefore the object of the invention to provide a printing device for impact printers with a type chain and a hammer unit operable with an electromagnetic armature, said printing device permitting the production of print images of different character densities.

SUMMARY OF THE INVENTION

This object is advantageously achieved in accordance with the invention in that for producing print images with different character densities an interposer unit determining the character density is provided between the hammer unit and the type chain, which consists of intermediate interposer elements operable by the hammers and aligned to the print positions.

In a particularly advantageous embodiment of the invention the same type chain can be used for producing print images with different character densities.

Another also particularly advantageous embodiment of the invention is characterized in that for producing print images with different character densities exchangeable type chains of different chain type character densities are applicable, the hammer density being designed for maximum chain type character density.

Advantageous embodiments of the invention are characterized in:

(a) that the interposer for a lower print image character density consists of a first comb of interposer elements having hammer impact faces which are respectively associated with a hammer, and type impact faces which are respectively centrally associated with a print type; that within a group of adjacent hammers for different print phases there is no interposer element associated to one or several hammers, and that the interposer elements in print direction, in a plane extending through the interposer elements show a cross-section preventing, upon the actuation of the interposer elements, their touching each other, and that the normals of the hammer impact face and of the type impact face of the interposer elements are staggered with respect to each other, that the maximum stagger amount of these normals in the cross-sectional plane is smaller than the hammer density measurement, (b) that the interposer for a higher print image character density consists of a second comb of interposer elements having hammer impact faces which are respectively associated with a hammer, and type impact faces which are each associated centrally with a printing type, (c) that the first and second interposer combs are arranged on the opposite sides of a support suitable or rotatable between hammer unit and type chain for the selecting of an interposer comb, (d) that near their two faces of operation the interposer elements are connected by one respective leaf spring to a support, (e) that in case (d) the ends of the leaf springs are engageable in recesses in the support and the interposer element that are filled with plastic material.

(f) that in case (c), upon setting of the first or second interposer combs, a mechanical switch is operable by means of which the circuit for the print control of different print image character densities can be controlled.

A circuit for the printer control for the first and second adjustable interposer comb is advantageously characterized in that for each interposer comb, by means of a circuit, printing phase pulses can be generated out of a chain cycle pulse which are applicable to a compare circuit by means of which, upon the coincidence of a character to be placed into a printing position with the printing type in front of said printing position, an associator circuit can be activated through which the print hammer for this printing position can be associated, and activated via a driver.

The associator circuit for an interposer in accordance with case (a) can advantageously be implemented as microprogram, read-only storage, or arithmetic circuit.

In accordance with that invention it is now possible to print with the same printing device in a paper-saving manner, on paper with small characters of a high character density (miniprint), and also to provide—in a manner required for instance for automatic character recognition—a print of low character density with larger letters (standard print).

An embodiment of the invention is represented in the drawings and will be described in detail below.

DETAILED DESCRIPTION OF THE INVENTION

Figure 1:
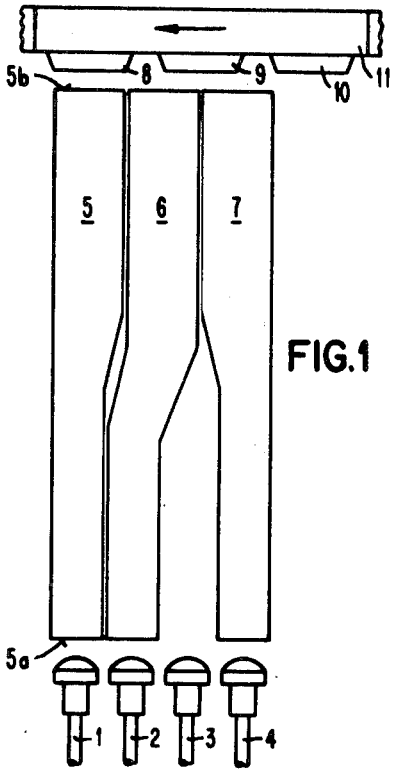
FIG. 1 is a schematic part representation of the printing hammers, the interposer elements (interposers), and the type chain, the interposer carrying out an adapting function between the high hammer density and the lower character density on the type chain.
Figure 2:
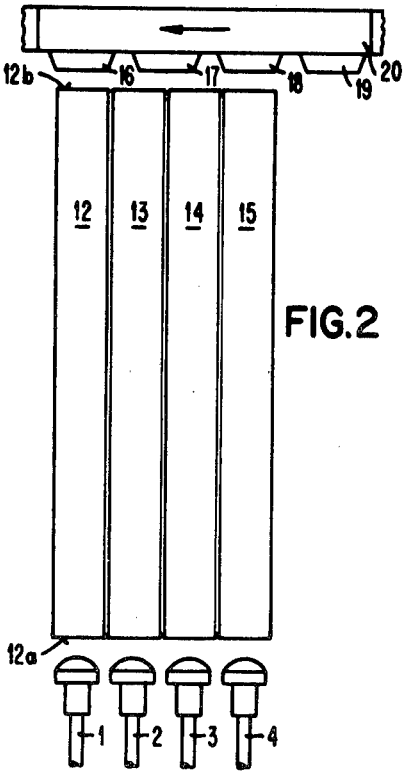
FIG. 2 is a schematic part representation of the printing hammers, the interposer, and the type chain for the case where the interposer does not carry out the adaptation between the hammer unit and the type chain.

In the following a type chain printer with exchangeable type chains will be described. The character densities on the type chains are to be different. The embodiment refers to type chains with two different character densities (high character density=MINIPRINT and low character density=STANDARD PRINT). The hammer density in the hammer unit of the printer remains unchanged upon the exchange of the type chains of differing character densities. The hammer density corresponds to the high character density. Between the hammer unit and the rotating type chain a so-called interposer (FIG. 3) is provided. This interposer consists of individual interposer elements (5,6,7; 12,13,14,15) to be operated respectively by a print hammer. These interposer elements are designed as oblong impact elements which near their ends are supported by two leaf springs (22). Upon the activation of a print hammer (1,2,3,4 in FIG. 1 and FIG. 2) the latter impinges against the interposer element (5,6,7 or 12,13,14,15) associated thereto which moves against the force of the two leaf springs in the direction of the print type (8,9,10 in FIG. 1; 16,17,18,19, in FIG. 2) and there produces the print required.

Where the character density on the type chain is adapted to the corresponding hammer density, the interposer elements of the interposer have the same density as the hammers in the hammer unit (FIG. 2). The printing process as such is generally known in accordance with prior art so that no further reference is made thereto. However, it is pointed out that the following should be noted when operating the printer: for reasons of a high quality print image adjacent hammers must not be fired one immediately after the other. Furthermore, the printing should take place serially, i.e., first one character is printed, and then the next one. The printing of the characters for a line is, however, taking place in a quasi-parallel manner, i.e. not serially in the sequence of the print positions, etc., but at discretion depending on the alignment of the printing types to the print positions so that owing to the very speedy print operations distributed over the entire line it looks as if the entire line were printed simultaneously—i.e. quasi-parallel.

The printing process is divided into individual phases. In a first phase (FIG. 2) for instance there is a check whether the first hammer (1st printing position) is aligned with the corresponding chain type, then, whether the third hammer (3rd printing position) is aligned with the corresponding chain type, then, whether the fifth hammer (5th printing position) is aligned with the corresponding chain type, etc. When there is a coincidence the respective character is printed. The succession of printing positions in the first phase can of course be different from that given above.

In the second phase it is checked whether the 2nd hammer (2nd printing position) is aligned with the corresponding chain type, then, whether the 4th hammer (4th printing position) is aligned with the corresponding chain type, etc.

When there is a coincidence printing is released, followed by an independent printing cycle for an extended period. Immediately following the printing release for a printing position the respective check for the printing of the next character is initiated for the subsequent printing position.

FIG. 2 shows in a schematic part representation type chain 20 moving in arrow with type elements 16, 17, 18, and 19. Between type chain 20 and print hammers 1,2,3,4 of the print hammer unit the interposer consisting, inter alia, of individual interposer elements 12,13,14,15 is arranged. Printing is performed as described by means of the impact of a print hammer against its associated interposer element, after which the character is printed on a record carrier not shown—arranged between type chain and interposer—by means of a ribbon or web.

FIG. 1 shows a schematic part representation where the hammer pitch is smaller than the character pitch on the type chain. Further pitch differences between the hammer unit and the type chain exist for reasons of an electronic compare time which, however, do not have to be considered in the specification of the present invention.

As an example for the differing pitch in the hammer unit and the type chain the following case should be considered: four print hammers 1, 2, 3 and 4 have three associated type elements 8, 9, 10. Type chain 11 moves in arrow direction.

In a printing phase, one of these chain types can be actuated by a print hammer associated thereto. The association of the print hammers to the individual chain types is effected via interposer elements 5,6,7. For the area to be considered of the four print hammers 1,2,3, and 4 the interposer consists of as many interposer elements 5, 6, and 7 as there are chain types 8, 9 and 10. In this example the interposer consists in the respective area of three interposer elements 5, 6, and 7. To the first print hammer 1 in the respective print hammer group interposer element 5 is associated. When interposer element 5 is actuated printing type 8 is printed. Hammer impact face 5*a* of interposer element 5 is centrally associated with hammer 1, and its type impact face 5*b* is centrally associated with printing type 8 to be operated. For the design of the interposer elements there is consequently a divergent asymmetrical structure with respect to the normal of the hammer impact face and the type impact face. Further information is given below on the effects of such an interposer element design.

Associated with hammer 2 is interposer element 6 by means of which printing type 9 can be operated later. The third print hammer 3 in the print hammer group in question remains without an associated interposer element. Associated with the fourth hammer 4 is interposer element 7 by means of which the third printing type 10 can be operated at a still later time. This arrangement described in FIG. 1 serves for the printing of the standard types (smaller character density than in the case of FIG. 2).

In FIG. 2, the normals of the hammer impact faces (e.g. 12*a*) coincide with the symmmetry lines of the interposer elements for the interposer elements 12, 13, 14, and 15 associated to the individual print hammers 1, 2, 3, 4. Printing takes place as described, only one hammer of a specific print hammer group being operated in the various printing phases: in the first printing phase hammer 1, then hammer 3, etc., in the second printing phase hammer 2, hammer 4, etc.

When an interposer is provided for adapting the higher hammer density to a lower chain type—character density, or for producing a print image with a lower character density maintaining the same unexchanged type chain there are specific circumstances which are considered by the design of the interposer elements (FIG. 1): as already mentioned above, FIG. 2 shows that the hammer impact face of an interposer element is each centrally associated with a hammer and the type impact face of each interposer element is centrally associated with the printing type.

When the printing chain moves in arrow direction there appear, as confirmed by experiment with the asymmetrically designed interposer elements (FIG. 1) better print images for interposer elements 5 and 6 than for the standard case for which according to FIG. 2 the symmetry line of an interposer element coincides with the hammer impact face normal. A theoretical quantiative explanation for such an improvement of the print image could not be found yet; but it appears obvious that the improvement of the print image is due to a so-called rolling effect. However, such an improvement is observed only in those cases where the hammer impact face normal is shifted with respect to the type impact normal in opposite direction to the direction of movement of the ribbon. This condition does not apply to interposer element 7. In the arrangement of this interposer element as seen on the drawing there would not be such an improvement of the print image. However, there are solutions according to which only those interposer elements are provided which permit an improvement of the print image.

It should of course be made sure when designing the interposer elements (in accordance with FIG. 1) that when operated they do not touch each other, i.e. the flanks of adjacent interposer elements must not touch each other when one of these two elements is operated.

Figure 3:
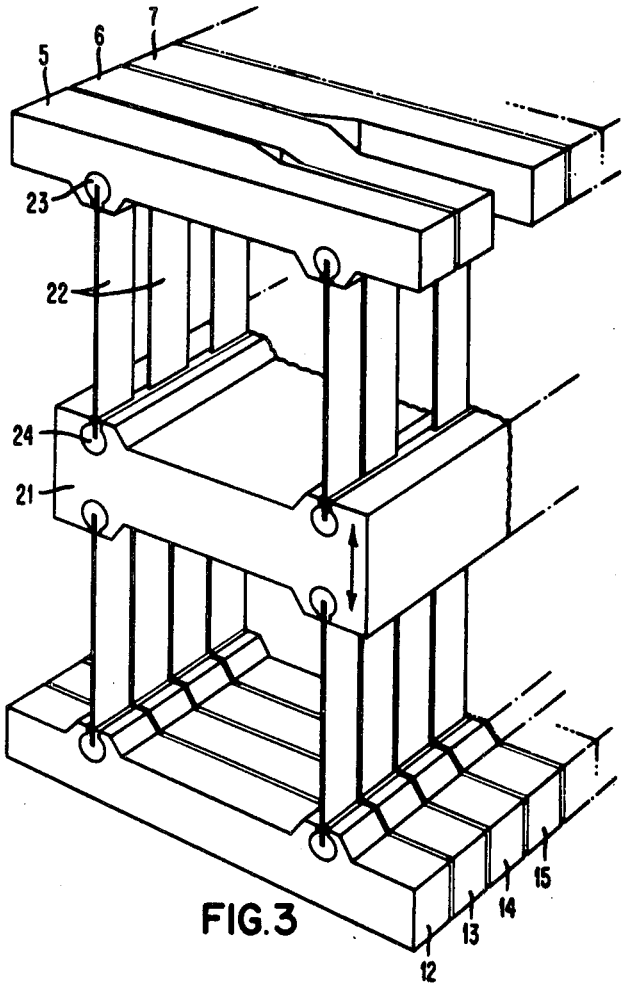
FIG. 3 is a schematic perspective view of an interposer unit with an interposer without, and with an interposer with adaptor function.

FIG. 3 shows an arrangement with two interposer combs. The first interposer comb (5, 6, 7, . . . ) is provided for standard print between print hammer unit and type chain, the other one (12, 13, 14, 14, . . . ) for miniprint.

At their ends, the individual interposer elements are connected by means of leaf springs (22) to a support 21, the leaf spring ends engaging in plastic-filled recesses 23 of the interposer elements and 24 of support 21. For a type chain exchange, for example, the support is shifted upward or downward in arrow direction, and mechanically fixed in a position which ensures a precise alignment of the respective interposer comb between type chain and print hammer unit. Upon such a shifting of the support an electrical switch (39, FIG. 4) is operated, the position (40, 41) of which indicates whether printing is to be done with the type chain for mini or standard print.

Other embodiments of an interposer comb exchange device are possible. The two interposer hammers could be arranged diametricaly on a rotating shaft.

The introduction of an interposer with adapting function requires only minor supplementation in the electronic system of the printer control. For specification purposes, some information will be given below which is part of the prior art but which serves for better understanding.

In a quasi-parallel printer of the present type the characters to be printed in a line, which are stored in a character buffer, are compared with the printing types aligned to the individual print positions, of the moving printing chain.

If in such a comparison of characters the printing type aligned in front of a printing position corresponds to the character to be printed, the printing process takes place, released via the hammer drive circuit.

As, for reasons given above, adjacent hammers must not be fired one directly following the other, the printing process is divided into individual printing phases. For that purpose, the printing phase pulses are electrically derived from a main pulse for each chain type.

For high character density (miniprint) it is possible to double the number of main pulses so that the printing process consists of two print phases. Each printing phase refers to the printing positions separated by one respective print position from each other, i.e., during the first printing phase the 1st, 3rd, 5th, 7th, 9th, etc. print position is checked, and subsequently, in the second printing phase, the 2nd, 4th, 6th, 8th, 10th, etc. print position. As in a printing process with an interposer without adapting function all print hammers can be operated; each print position in the present case has also an associated print hammer.

Figure 4:
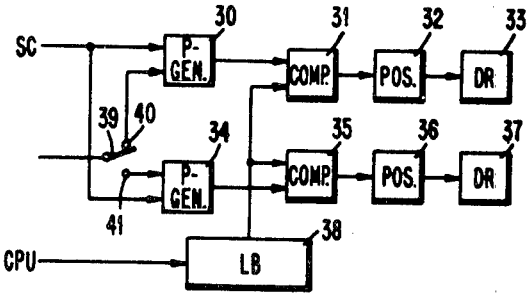
FIG. 4 is a block circuit diagram for the printer control, taking into consideration the interposer with and without adaptor function.

In FIG. 4, a circuit arrangement for the electronic printer control is described which considers both the interposer without adapter function and the interposer with adapter function. This circuit arrangement refers to an interposer comb switchable from miniprint to standard print or vice versa, as described in FIG. 3. When the interposer comb is switched to one of the two above prints with differing character densities a mechanical switch S 39 is actuated. When the interposer comb is set to the miniprint (high character density) the arm of the switch is connected to contact 40; when the interposer comb is set to the standard print (lower character density) the arm of the switch is connected to contact 41. It is the object of circuit 30 to generate, upon the application of a main pulse (scan pulse) and of a switch 39 connected to contact 40, a corresponding number of print phase pulses (subscans). These print phase pulses are electronically derived from the main pulse. In the embodiment of FIG. 2 two subscan pulses would be generated for the miniprint (high character density) out of one scan pulse. During the individual print phases, as mentioned above, a character comparison is made in circuit COMP 31 between the character (contained in line buffer 38) to be printed in a specific print position and the printing type in front of that print position. If they are the same the driver circuit for the print hammer associated to the respective print position is energized via circuit 32 in order to initiate the printing process. Circuit POS 32 effects an association between the print position in question and the hammer associated with this print position. In case of miniprint (FIG. 2) such an association is no problem as each hammer 1–4 has a respective print position associated via the respective interposer element 12–15. Slightly modified conditions appear in the print control electronics when the interposer is used to produce the standard print. In that case, switch 39 is connected to contact 41 and, in an analogy to circuit 30, circuit 34 generates, for an interposer arrangement in accordance with FIG. 1, out of one scan pulse three subscan pulses which are applied to character compare circuit 35. In analogy to circuit 31, a corresponding character comparison is carried out in this circuit. If there is a coincidence circuit 36 operates driver circuit 37 which operates the print hammer associated to a specific print position. Circuit 36 associates the respective hammer to the individual print positions. For a hammer interposer arrangement in accordance with FIG. 1, hammer 1 would be associated to the first print position, and hammer 2 to the second print position; the third hammer would remain unused, while hammer 4 would be associated to the fourth print position. For all further print positions this period of association would be repeated. Such an association could take place with standard means algorithmically either through hardware or micro-program realization. Another possibility would be an association table which could be realized as a read-only storage. The implementation of such an association is not the subject of the invention; it can be realized quite simply with conventional means. For an arrangement in accordance with FIG. 1, there is an association in accordance with the following table:

print position—1 2 3 4 5 6 7 8 9 etc.

hammer no.—1 2 4 6 8 9 10 12 etc.

Consequently hammers 3, 7, 11, 15, etc. remain unused for standard print.

The following is given as an algorithm for calculating the hammer number from the print position:

position of magnet = rounded off integer of $4/3 \times$ print position.

It is once more pointed out that it is also possible to produce a print image with wider and closer character spacing with only one and the same type chain (e.g. 11 in FIG. 1), using the interposer arrangement as disclosed by the invention. However, in that case the character size itself would remain unchanged. The use of an interposer in accordance with FIG. 2 would present a closer character spacing, and the use of an interposer in accordance with FIG. 1 would present a wider character spacing.

We claim:

1. Apparatus for changing the density of printed characters recorded in a print line by a printer having a plurality of print hammers and a moving type member having a series of type elements thereon, comprising:

a first set of interposers for transmitting motion imparted to said hammers toward said member, there being one interposer for each said hammer;

a second set of interposers for transmitting motion imparted to said hammers toward said member, the number of interposers being less than the number of hammers of said plurality in corresponding groups of hammers and interposers; and means supporting said interposer sets and movable to place a selected one of said sets between said hammers and said member.

2. Apparatus as described in claim 1 wherein each interposer has a type element-engaging end and a hammer-impacting end and wherein said hammers are uniformly spaced along said print line and said type element-engaging ends of the interposers in each of said sets are uniformly spaced along said print line.

3. Apparatus as described in claim 2 wherein the hammer-impacting ends of said second set of interposers are irregularly spaced along said print line.

4. Apparatus as described in claim 1 wherein said interposers in said second set are arranged in repeating groups of interposers along said print line.

5. Apparatus as described in claim 1 wherein said second set of interposers includes interposers having hammer-impacting end portions and type element-engaging end portions offset in relation to each other.

6. Apparatus for changing the density of printed characters recorded in a print line by a printer having a moving type member with a series of type elements thereon and a type hammer for each character position in said print line movable toward said member to effect said recording comprising:

a first set of reciprocable interposers for transmitting motion from said hammers towards said member, there being one interposer for each said hammer;

a second set of reciprocable interposers for transmitting motion from said hammers toward said member, the number of interposers being less than the number of hammers in said plurality; and means supporting said interposer sets and movable to place a selected one of said sets between said hammers and said member.

7. Apparatus as described in claim 6 wherein said hammers and said interposers of said second set are formed into a plurality of corresponding groups along said print line and each said group of interposers has fewer interposers than there are in the corresponding hammer group.

8. Apparatus as described in claim 6 wherein said interposers are each supported on at least one leaf spring secured to said support means.

* * * * *